US008590174B2

(12) United States Patent
Rose et al.

(10) Patent No.: US 8,590,174 B2
(45) Date of Patent: Nov. 26, 2013

(54) SYSTEM AND METHOD FOR REMOVING SOIL FROM SEED

(75) Inventors: Bill L. Rose, Hubbard, OR (US); Thomas R. Miles Sr., Portland, OR (US); Thomas R. Miles, Jr., legal representative, Portland, OR (US); Agostino Gaude, Vicoforte (IT)

(73) Assignee: Rose Agri-Seed, Inc., Canby, OR (US)

( * ) Notice: Subject to any disclaimer, the term of this patent is extended or adjusted under 35 U.S.C. 154(b) by 431 days.

(21) Appl. No.: 13/103,725

(22) Filed: May 9, 2011

(65) Prior Publication Data

US 2012/0216419 A1 Aug. 30, 2012

Related U.S. Application Data

(60) Provisional application No. 61/447,590, filed on Feb. 28, 2011.

(51) Int. Cl.
*F26B 5/08* (2006.01)

(52) U.S. Cl.
USPC ... 34/328; 34/381; 34/90; 34/137; 134/104.2; 435/291.1; 210/613; 165/903; 71/11

(58) Field of Classification Search
USPC ..... 34/328, 380, 381, 413, 497, 60, 80, 90, 34/137; 134/104.2, 134; 435/290.1, 290.2, 435/291.1; 210/175, 612, 613; 165/902, 165/903; 71/10, 11
See application file for complete search history.

(56) References Cited

U.S. PATENT DOCUMENTS

| | | | | |
|---|---|---|---|---|
| 369,768 | A | | 9/1887 | Booker |
| 1,360,336 | A | | 11/1920 | Warrenfeltz |
| 1,431,978 | A | | 10/1922 | Nesbitt |
| 3,097,159 | A | | 7/1963 | Ofner |
| 3,458,045 | A | | 7/1969 | Dudley |
| 3,463,314 | A | | 8/1969 | Feterl |
| 3,552,465 | A | | 1/1971 | Asper |
| 3,788,003 | A | * | 1/1974 | Creighton et al. ..... 47/56 |
| 4,016,656 | A | | 4/1977 | Batscheider et al. |
| 4,079,696 | A | | 3/1978 | Weber |
| 4,253,946 | A | | 3/1981 | Ludwig |
| 4,369,585 | A | * | 1/1983 | Berkoff et al. ..... 34/63 |
| 4,458,428 | A | * | 7/1984 | Saeman ..... 34/506 |
| 4,877,039 | A | | 10/1989 | Somerville et al. |
| 4,895,106 | A | | 1/1990 | Barnes |

(Continued)

FOREIGN PATENT DOCUMENTS

| | | | | |
|---|---|---|---|---|
| FR | 2570247 | * | 3/1986 | ..... A01G 1/00 |
| SU | 1001886 | * | 3/1983 | ..... A01G 7/16 |

*Primary Examiner* — Steve M Gravini
(74) *Attorney, Agent, or Firm* — Klarquist Sparkman, LLP

(57) ABSTRACT

An exemplary system for removing soil from seed comprises an auger portion, a centrifuge portion and/or a dryer portion. The auger portion comprises an inclined enclosure and an auger positioned within the enclosure and is configured to mix seed with a liquid, remove soil from the seed, and separate washed seed from the liquid and the removed soil. The centrifuge portion comprises at least one centrifuge having an outer drum and a rotatable inner basket positioned within the outer drum. The inner basket comprises a side wall having a plurality of apertures. The inner basket is configured to receive washed seed from the auger portion within the inner basket and to centrifugally separate additional liquid from the washed seed, the separated liquid passing through the plurality of apertures into the outer drum. The dryer portion further reduces moisture content of the seed using heat.

20 Claims, 6 Drawing Sheets

(56) References Cited

U.S. PATENT DOCUMENTS

| | | | | |
|---|---|---|---|---|
| 5,105,563 | A * | 4/1992 | Fingerson et al. | 34/203 |
| 5,633,163 | A * | 5/1997 | Cameron | 435/262 |
| 6,112,679 | A * | 9/2000 | Borstmayer et al. | 111/173 |
| 6,510,367 | B1 * | 1/2003 | McQuinn | 700/241 |
| 6,996,917 | B2 * | 2/2006 | Anderson | 34/209 |
| 2009/0205249 | A1 * | 8/2009 | Rubin | 47/58.1 SC |
| 2011/0030232 | A1 * | 2/2011 | May | 34/73 |
| 2011/0132814 | A1 * | 6/2011 | Miller | 209/139.1 |
| 2012/0216419 | A1 * | 8/2012 | Rose et al. | 34/328 |
| 2013/0213841 | A1 * | 8/2013 | Ward | 206/386 |

* cited by examiner

SYSTEM AND METHOD FOR REMOVING SOIL FROM SEED

CROSS REFERENCE TO RELATED APPLICATION

This application claims the benefit of U.S. Provisional Application No. 61/447,590, filed Feb. 28, 2011.

FIELD

This application pertains to systems and methods for removing soil from seed, such as grass seed, or other small granular objects.

BACKGROUND

Much of the world's grass seed is grown in the United States and then exported internationally. Unprocessed grass seed typically includes a significant amount of soil. For example, creeping bentgrass seed can contain around 0.6% soil. For various reasons, some countries impose restrictions on the amount of soil that can be present in grass seed imported into those countries. For example, some countries require that imported grass seed contain no more than 0.01% soil. Australia, Mexico and Japan are examples of countries that have imposed such soil content restrictions.

In the past, faced with the difficulties and inefficiencies of separating the soil and grass seed, exporters have tried coating dirty grass seed to hide the soil instead of actually removing the soil. However, this technique still leaves high soil content in the grass seed in violation of the soil content restrictions. There is therefore a need to effectively remove soil from grass seed to conform with these soil content restrictions prior to shipping the grass seed.

SUMMARY

Described herein are systems and methods for removing soil from seed. In some embodiment, cleaned seed can be produced that contains less than 0.01% soil.

An exemplary seed cleaning system includes an apparatus for removing soil from seed comprising an inclined inner enclosure comprising a first end portion and a second end portion having a higher elevation than the first end portion; a seed input adjacent the first end portion for introducing seed having a first soil content into the inner enclosure, and a seed output adjacent the second end portion for outputting seed having a second soil content from the inner enclosure, the second soil content being less than the first soil content; a liquid inlet for introducing liquid into the inner enclosure and at least one liquid outlet in the inner enclosure between the seed input and the seed output, the liquid outlet configured to drain liquid and soil from the inner enclosure; and a coreless auger positioned within the inner enclosure and extending from adjacent the seed input to adjacent the seed output, the auger configured to rotate relative to the inner enclosure and convey seed from the seed input toward the seed output.

In some embodiments, the first soil content is greater than about 0.6% and/or the second soil content is less than 0.01%.

In some embodiments, the at least one liquid output comprises a plurality apertures located in a bottom portion of the inner enclosure. In some of these embodiments, the apparatus further comprises a mesh screen covering the liquid outlet. The mesh screen comprises apertures sized smaller than the seed such that the mesh screen allows liquid and soil to pass through the liquid outlet. The mesh screen can be positioned between the auger and an inner surface of the inner enclosure. The plurality of apertures can comprise at least one aperture positioned below an operational liquid level within the enclosure and a slotted aperture positioned above the operational liquid level.

Some embodiments further comprise a trough positioned below the inner enclosure and configured to contain liquid and soil drained from the inner enclosure.

In some embodiments, the liquid inlet is positioned adjacent to the seed input.

In some embodiments, the seed is creeping bentgrass seed.

In some embodiments, the coreless auger rotates about a non-linear axis of rotation within the inner enclosure.

An exemplary system for removing soil from seed comprises: an auger portion comprising an inclined enclosure and an auger positioned within the enclosure, the auger portion configured to mix seed with a liquid within the enclosure, to remove soil from the seed, and to separate washed seed from the liquid and the removed soil; a centrifuge portion comprising at least one centrifuge having an outer drum and a rotatable inner basket positioned within the outer drum, the inner basket comprising a side wall having a plurality of apertures, the inner basket configured to receive washed seed from the auger portion within the inner basket and to centrifugally separate additional liquid from the washed seed, the separated liquid passing through the plurality of apertures into the outer drum; and a dryer portion configured to receive partially dried seed from the centrifuge portion and configured to further reduce moisture content of the seed using heat.

In some embodiments, the centrifuge portion comprises at least two centrifuges. The auger portion can further comprise a forked seed outlet coupled to the inclined enclosure and comprising an adjustable valve for selectively conducting washed seed into different centrifuges. The system can be configured to continuously output washed seed from the auger portion into at least one of the centrifuges while at least another of the centrifuges rotates to dry washed seed.

In some embodiments, the at least one centrifuge further comprises a mesh screen coupled to an inner surface of the side wall of the inner basket, the mesh screen covering the plurality of apertures in the side wall, the mesh screen comprising apertures sized smaller than the seed.

In some embodiments, the centrifuge further comprises a stir bar pivotally mounted to the outer drum such that, when the stir bar is in an operation position, the stir bar is positioned within the inner basket adjacent the side wall and causes seed to move inwardly away from the side wall when the inner basket is rotated.

In some embodiments, the dryer portion comprises a seed inlet, a drying bed within an enclosure, a seed outlet, a heated air source, and a heated air outlet, wherein the dryer portion is configured to move seed via vibration from the seed inlet, across the drying bed and to the seed outlet while heated air draws moisture from the seed and out of the enclosure via the heated air outlet.

In some embodiments, the moisture content of the seed exiting the auger portion is greater than 25%, the moisture content of the seed exiting the centrifuge portion is less than 25%, and the moisture content of the seed exiting the dryer portion is less than 10%.

An exemplary method of removing soil from grass seed comprises: introducing grass seed and a liquid into a lower end portion of an inclined tubular enclosure, the enclosure containing a rotatable coreless auger extending from the lower end portion to an upper end portion of the enclosure; rotating the auger to mix the grass seed with the liquid to separate soil from the grass seed while moving the grass seed from the lower end portion of the enclosure toward the upper end portion of the enclosure; draining the liquid and removed soil from the enclosure via at least one drain aperture in the enclosure located between the lower and upper end portions of the enclosure; outputting washed grass seed from the upper end portion of the enclosure into a centrifuge; spinning the centrifuge to reduce the moisture content of the grass seed; and further reducing the moisture content of the grass seed using heat, such as with a fluidized bed dryer.

The foregoing and other objects, features, and advantages of the invention will become more apparent from the following detailed description, which proceeds with reference to the accompanying figures.

DETAILED DESCRIPTION

Described here are embodiments of systems, components thereof, and related methods for removing soil from grass seed or similar objects. The following description is exemplary in nature and is not intended to limit the scope, applicability, or configuration of the invention in any way.

As used in this application and in the claims, the singular forms "a," "an," and "the" include the plural forms unless the context clearly dictates otherwise. The term "includes" means "comprises." Further, the term "coupled" generally means electrically, electromagnetically, and/or physically (e.g., mechanically or chemically) coupled or linked and does not exclude the presence of intermediate elements between the coupled or associated items absent specific contrary language.

The embodiments described herein can be used to remove excess soil from seed, or similar objects, by washing and drying the seed in continuous or batch processes. Exemplary objects to be washed can include, but are not limited to, grass seed, such as creeping bentgrass seed, legumes and vegetable seeds.

With reference to the attached figures, the system can include an auger portion 2, a centrifuge portion 4, and/or a dryer portion 6. The auger portion 2 can be used to mix dirty seed (seed having excess soil content) with a cleaning liquid and separate excess soil from the seed. In some embodiments, the centrifuge portion 4 can be used to reduce the moisture level of and/or further clean seed output from the auger portion 2. In other embodiments, the centrifuge portion 4 can be used as a standalone device to remove excess soil from the seed without the use of an auger portion 2. The dryer portion 6 can be used to further reduce the moisture level of cleaned seed such that the seed can be stored, shipped and/or further processed.

Auger Portion

Figure 3:
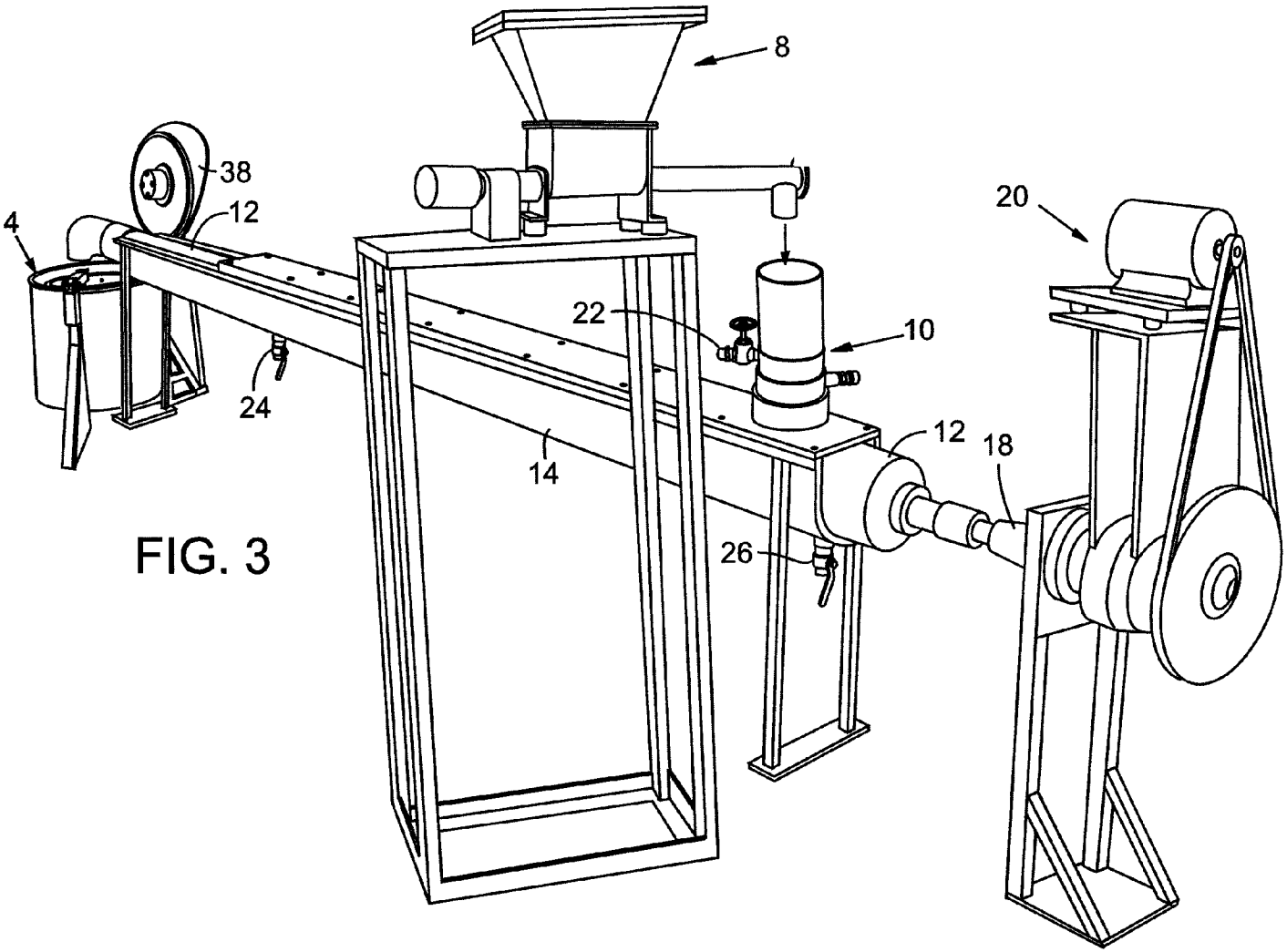
FIG. 3 shows a portion of an exemplary seed cleaning system comprising an auger portion and a centrifuge portion.
Figure 4:
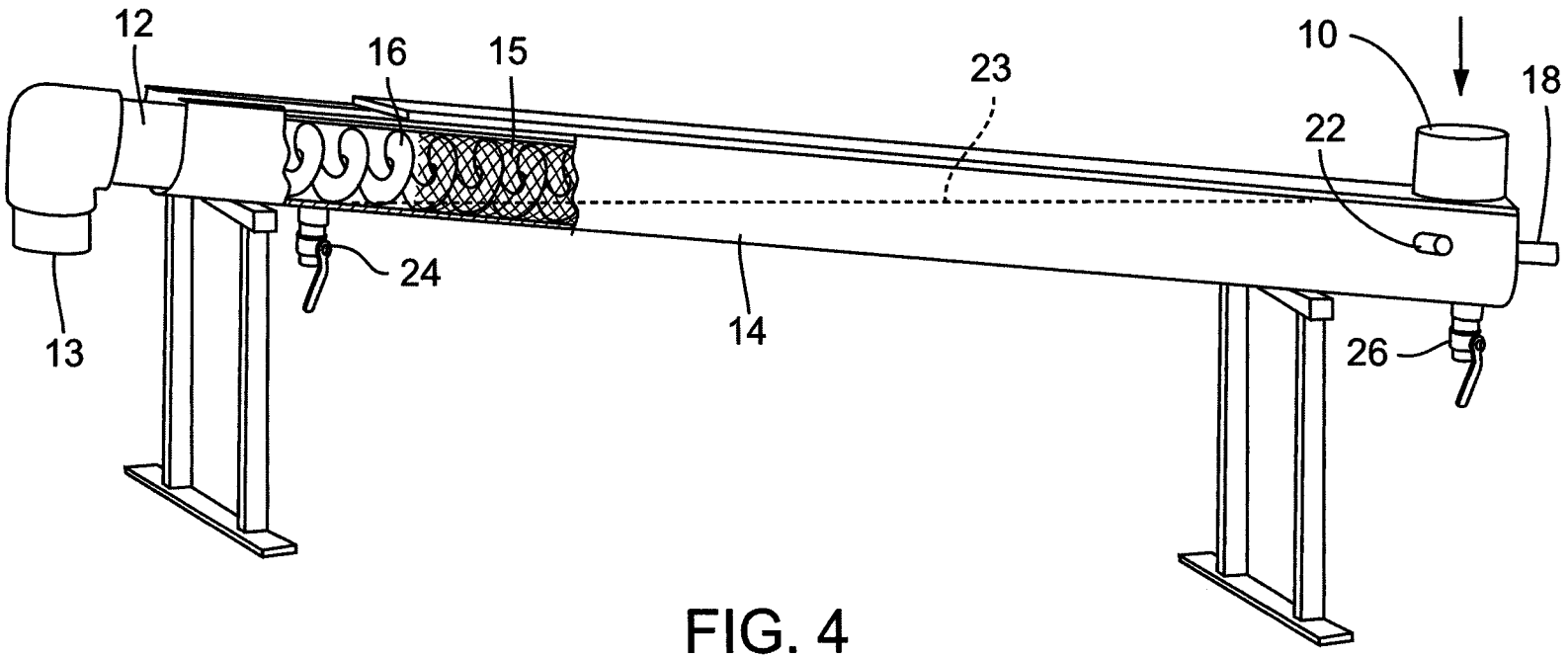
FIG. 4 is a partial cut-away view of the auger portion of FIG. 1, showing an auger and a mesh screen within a tubular enclosure.
Figure 5:
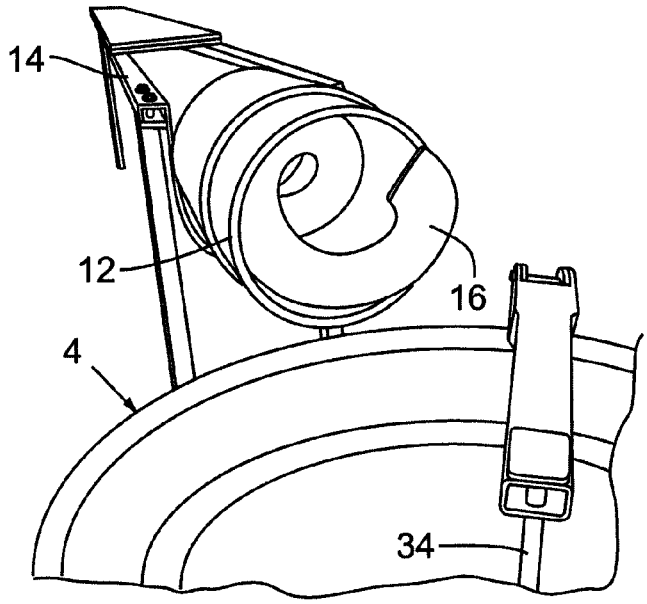
FIG. 5 shows an output end of the auger portion and the centrifuge portion of the system of FIG. 1.

With reference to FIGS. 3-5, the auger portion 2 can include a seed feeder 8, a seed input 10, an inner enclosure 12, an outer enclosure, or trough, 14, an auger 16, a crank shaft 18, a drive assembly 20 and a liquid inlet 22. Dirty seed can be fed from the seed feeder 8, through the seed input 10 and into the inner enclosure 12. Cleaning liquid can be fed through the liquid inlet 22 and into the inner enclosure 12 where the cleaning liquid mixes with the dirty seed.

The inner enclosure 12 can be an inclined, elongated tube that is closed at a first end and open at an opposite second end. The inner enclosure 12 can vary in length, being about 20 feet long in some embodiments. In some embodiments, the inner enclosure 12 can be made of a polymeric material, such as PVC. The open second end of the inner enclosure 12 can be slightly elevated relative to the closed first end. The open discharge end of the inner enclosure can include an angled component 13 that directs or conducts the flow of washed seed out of the auger portion 2, such as into the centrifuge portion 4. In some embodiments, a forked component 17 can be coupled to the discharge end of the inner enclosure (see FIG. 2) for conducting the washed seed into multiple destinations, as described below.

The auger 16 is positioned within the inner enclosure 12 such that the auger can be rotated relative to the inner enclosure, such as by the drive assembly 20 via the crank shaft 18. In some embodiments, such as in the embodiment shown in FIG. 5, the auger 16 can be "coreless," meaning the auger has no central axial portion, but instead comprises a helical or coiled shape. A coreless auger 16 can allow for increased flexibility and can allow for increased axial fluid flow through the vacant core region of the auger. This can improve the mixing and soil separation within the inner enclosure as the auger rotates. In some embodiments, the auger 16 can be comprised of rigid material, such as metal, such as steel. The outer diameter of the auger 16 can be similar or slightly smaller than the inner diameter of the inner enclosure 12, which can be about 6" in some embodiments, such that the radial edge of the auger is adjacent or in contact with the inner surface of the inner enclosure. The auger 16 can be rotated at various speeds, such as approximately 70 RPM in one exemplary method. As the auger 16 rotates, the auger can cause the seed/liquid mixture within the inner enclosure 12 to move axially up the incline toward the open discharge end of the inner enclosure.

The inner enclosure 12 can include a plurality of apertures, such as small holes and slots, on center in the bottom of the inner enclosure to drain liquid and soil from the seed. The apertures can be larger than the diameter of the seed, such as round holes about 1-2 inches, such as about 1.5 inches, in diameter. The apertures can be spaced from about a few inches to more than a foot apart. In some embodiments, the apertures are 1.5 inches in diameter and spaced about 4 inches apart. In some embodiments, near the upper, discharge end of the inner enclosure 12, the apertures can comprise an extended slot or other type of aperture that is larger in size such that if the liquid input rate is too high, the excess liquid can be drained into the outer enclosure 14 at a faster rate through the slot than through the apertures nearer to the declined end of the inner enclosure.

The apertures can be covered with a fine mesh screen 15 (see FIG. 4) that allows liquid and soil to pass through the apertures and out of the inner enclosure 12 but prevents the seed from passing through the apertures. In some embodiments, the mesh 15 can form an annular layer along the inner surface of the inner enclosure 12 and around the auger 16. In some embodiments, the mesh 15 can extend the entire length of the inner enclosure 12, while in other embodiments, the mesh extends along the portion of the inner enclosure comprising the apertures.

During operation, the inner enclosure can be partially filled with cleaning liquid. The liquid level 23 (see FIG. 4) can remain relatively steady during continuous operation as the seed is washed and moved toward and out of the discharge end of inner enclosure. The liquid level 23 can be such that the lower portion of the inner enclosure 12 is mostly or completely filled with liquid while the upper discharge end portion is mostly dry. In some embodiments, the water level 23 can be about even with the elevation of a valved drainage outlet 24 in the outer enclosure 14. The liquid level can also be about even with a transition between smaller apertures to a slot in the inner enclosure 12. During operation, the liquid flow rate at the inlet 22 can be slightly greater than the flow rate of liquid and soil through the apertures out of the inner enclosure 12. The flow rate through the drainage outlet 24 out of the outer enclosure can be about the same as the flow rate through the apertures out of the inner enclosure. Some of the soil in the liquid within the outer enclosure can settle downward toward the lower drain valve 26 can collect there while the liquid and some of the soil flows out of the upper drainage outlet 24. The lower drain valve 26 can be used to periodically drain out the area between the outer enclosure 14 and the inner enclosure 12. The lower drain valve 26 can be used to remove liquid and soil buildup within the outer enclosure, such as when the system is not operating.

The washing fluid can be recycled. For example, in some embodiments, fluid exiting the outer enclosure through the drainage outlet 24 can be collected and fed back into the fluid inlet 22. In some embodiments, the collected fluid can be stored in a tank prior to being fed back into the fluid inlet. In some embodiments, the recycled fluid can be filtered or allowed to settle out, such as in the tank, to remove soil and/or other substances from the fluid.

The rotating auger 16 can convey the seed toward the seed discharge end of the inner enclosure 12 and can also agitate the seed and liquid mixture, such as in radial and/or side-to-side directions, to improve the removal of soil from the seed. The auger 16 can be flexible due to the lack of an axial core, which can allow the auger to bend and conform to the shape of the inner enclosure 12. This flexibility of the auger 16 can allow the auger to be used with a curved or otherwise non-linear inner enclosure 12, for example. In some such embodiments, the inner enclosure 12 can be level or extend downward from the closed end before curving or bending at an intermediate portion and extending upward toward the open discharge end. As the seed moves upward toward the open discharge end, the liquid can be drained away leaving moist seed having reduced soil content that can be conducted out of the open discharge end of the inner enclosure 12 through the angled component 13 and can fall into the centrifuge 4. The washed seed exiting the auger portion 2 can have a moisture content of about 25-40%, such as about 26-30%.

Liquid and soil passing through the mesh can be contained by the outer enclosure 14. In some embodiments, such as the embodiment shown, the outer enclosure 14 can be a trough with a lid covering the trough. The outer enclosure 14 can comprise any type of liquid containing trough capable of capturing and containing the dirty liquid exiting the inner enclosure 12. The outer enclosure 14 can fit snuggly around the lower end of the inner enclosure 12 to prevent liquid escape at the lower end and can be open at the opposite upper end. The outer enclosure 14 can include at least one drain valve 24 (see FIG. 7) at a location adjacent to, such as a few feet short of, the open end that can be large enough such that all liquid and soil that rises to that elevation within the outer enclosure can drain out of the outer enclosure before flowing out of the open end. The outer enclosure 14 can also include a lower drain valve 26 (see FIG. 7) near the lower end that can be used to drain the entire outer enclosure. In operation, dirty seed can be fed into the inner enclosure 12 at a rate corresponding to the auger rotation rate while the cleaning liquid input rate can be adjusted to match. Too little liquid can be insufficient for cleaning, while too much liquid can reduce the effectiveness of the cleaning process and/or overflow the upper end of the inner enclosure 12. The inclination angle of the inner enclosure 12 can also be adjusted to optimize the cleaning process. If the angle is too small, the liquid and seed can flow out the discharge end too quickly without being sufficiently cleaned. If the angle is too steep, gravity can cause the seed to slide or flow back down toward the seed input 10 faster than the auger 16 can move the seed toward the discharge end. The cleaning liquid can comprise a mixture of ingredients designed to separate soil from the seed. In some embodiments, the cleaning liquid can comprise water, chlorine bleach, surfactant and/or other ingredients. The auger portion 2 can be capable of washing seed, such as creeping bentgrass seed, such that the washed seed exiting the auger portion has less than 0.01% soil content.

Centrifuge Portion

A centrifuge 4 can be used with the auger portion 2 or as a standalone device to remove soil from seed. Some embodiments of the seed cleaning system can include only one centrifuge 4, such as in FIG. 1, while other embodiments can include more than one centrifuge, such as two identical centrifuges, positioned next to one another, as shown in FIG. 2.

Figure 6:
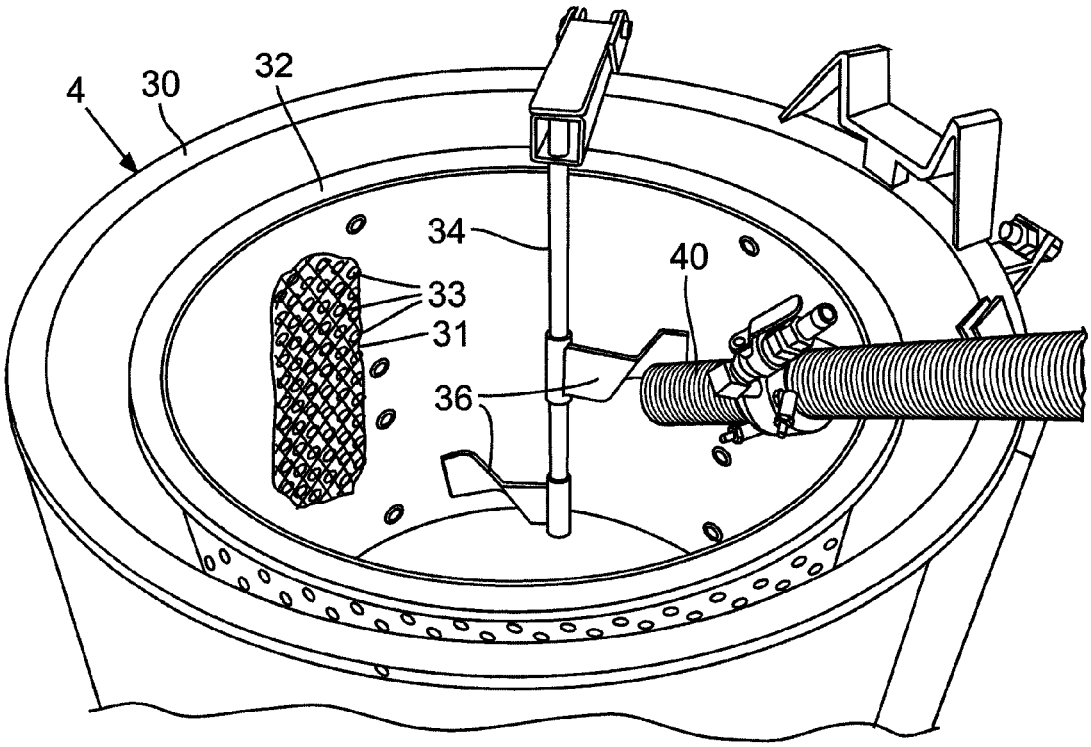
FIG. 6 shows internal portions of the centrifuge portion of FIG. 1.
Figure 7:
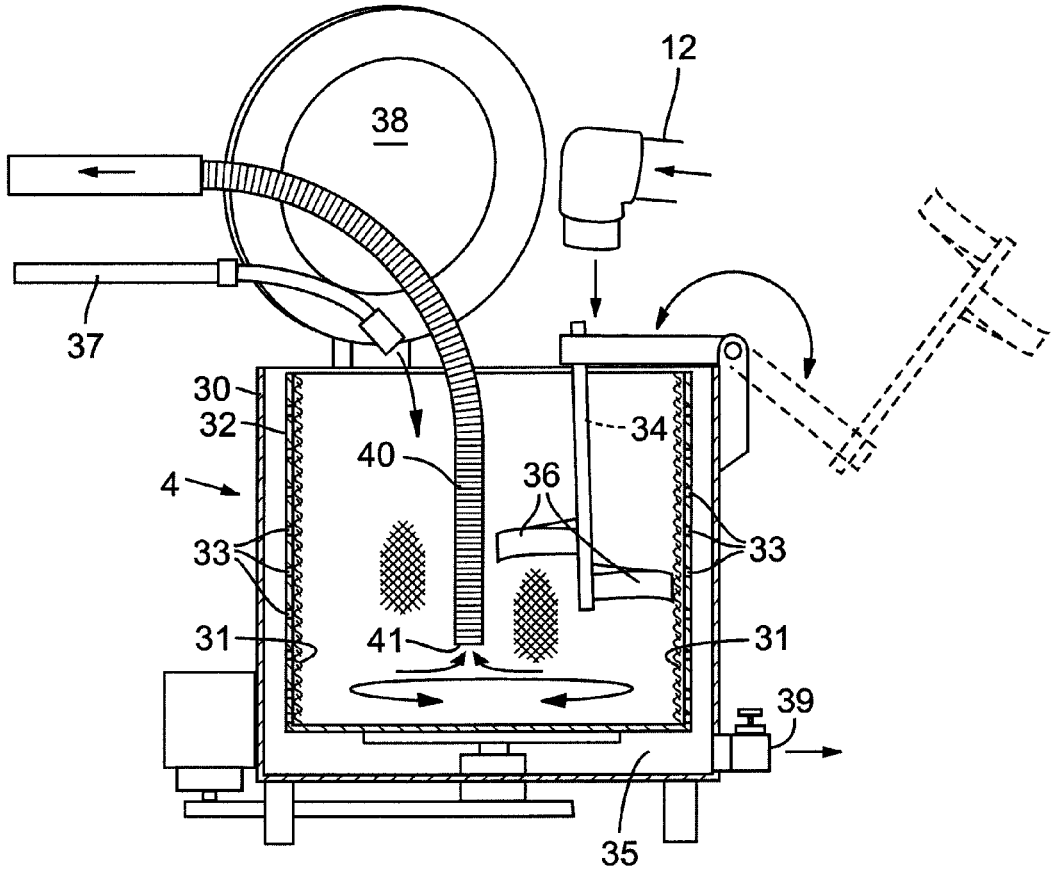
FIG. 7 shows a cross-sectional view of the centrifuge portion of FIG. 1.

As shown in FIGS. 6 and 7, the centrifuge 4 can comprise a stationary outer drum 30 and a rotatable inner basket 32. The inner basket 32 can comprise a side wall having plurality of small holes 33 lined with a fine mesh 31 such that liquid and soil can pass through the mesh and holes into the space between the inner basket 32 and the outer drum 30, while the seed is constrained within the basket 32.

The centrifuge can have at least two programmed cycles. A first cycle can be configured for washing seed and a second cycle can be for draining soil and liquid from the centrifuge. During the first cycle, the inner basket and outer drum can be filled with seed and liquid and the inner basket can be spun or agitated back and forth to clean the seed. During the second cycle, the inner basket 32 can be rotated at a high rate, forcing liquid and soil radially outward through the mesh 31 and holes 33 and into the outer drum 30 while the seed remains within the inner basket 32. As shown in FIG. 7, liquid can be fed into the basket via a conduit 37. Liquid and soil passing through the holes 33 can collect in an area 35 between the basket 32 and the drum 30. This area can be drained via a drain valve 39.

In some embodiments, a vacuum conduit 40 can be used to draw seed out of the basket 32 via the inlet 41 and deposit the drawn seed, for example, into the dryer portion 6. The vacuum conduit 40 can be coupled to a vacuum unit that creates sufficient suction at the inlet 41 to draw the seed through the conduit. The vacuum conduit 40 can be flexible configured to be removed from the centrifuge when not in use.

In some embodiments, the inner basket 34 can be removed from the centrifuge 4. After seed is spin-dried in the centrifuge, the basket 34 can be removed and the seed can be emptied into the in dryer portion 6, or the basket can be embodied onto a conveyor mechanism that can be used transport the seed to the dryer portion 6.

The centrifuge 4 can also comprise a stir bar 34 pivotally mounted to the outer drum 30, as shown in FIG. 7. The stir bar 34 is held stationary while the inner basket 32 rotates. The stir bar 34 can include blades 36, which can be positioned near the perimeter of the inner drum 32 in a functional position shown in FIG. 6. The blades can be shaped to mix and agitate the seed in the inner basket, such as by forcing the circulating seed to move radially inward away from the side wall, and enhance the soil removal process. The stir bar 34 can be pivoted out of the drum 32 to a non-functional position, as shown in FIG. 7. For example, the stir bar 34 can be placed in the nonfunctional position and the lid 38 can be closed during the spinning/drying process.

During the spin-drying process, the centrifuge 4 can reduce the moisture content of the seed. For example, the centrifuge washing process can increase the seed moisture to about 55%, and the spin-drying process can reduce the moisture to about 10-30%, such as to about 24%.

The some embodiments, one or more centrifuges 4 can be operated in conjunction with the auger portion 2. As washed seed reaches the end of the inner enclosure 12 via the auger 16, the seed can simply fall into an inner basket 32 of a centrifuge 4. As shown in FIG. 2, the open, inclined end of the inner enclosure 12 can include a forked portion 17 having two or more exits with a valve 19, such as an adjustable flap, for regulating through which exit the cleaned seed passes. Each of the exits can be positioned above a different centrifuge 4. As one of the centrifuges 4 is being filled with washed seed from the auger portion 2, another centrifuge can be operated to dry the washed seed, drained of liquid and soil, and the seed removed. The valve 19 in the forked portion 17 of the inner enclosure 12 can then be adjusted to begin refilling the emptied centrifuge while the just-filled centrifuge is run through the drying processes and emptied. In this way, the auger portion 2 need not be stopped while the centrifuge 4 is operated and emptied, allowing for a continuous process.

Dryer Portion

Figure 1:
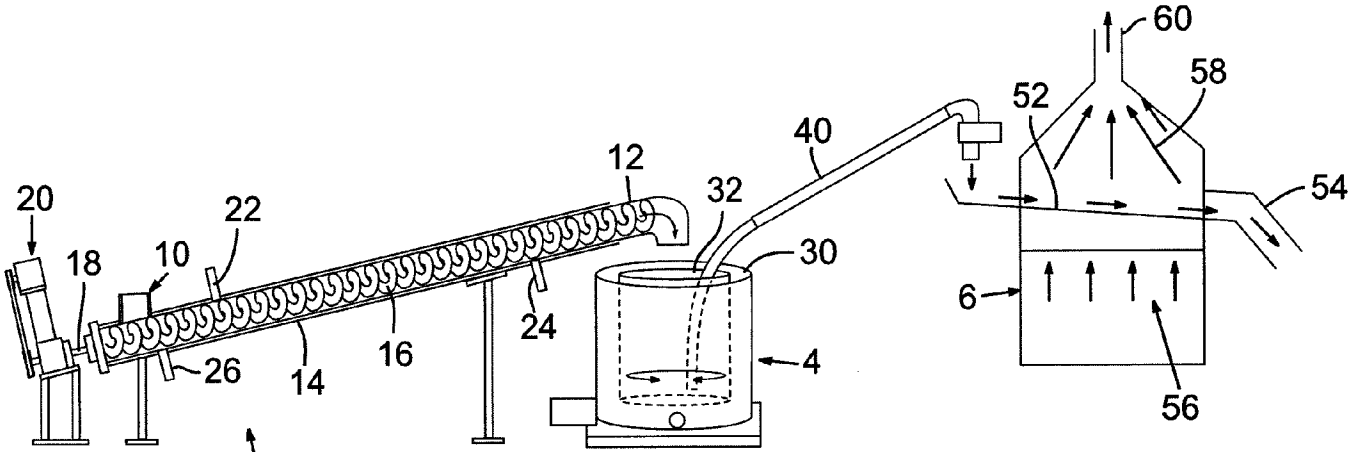
FIG. 1 shows an exemplary seed cleaning system including an auger portion, a centrifuge portion, and a dryer portion.
Figure 2:
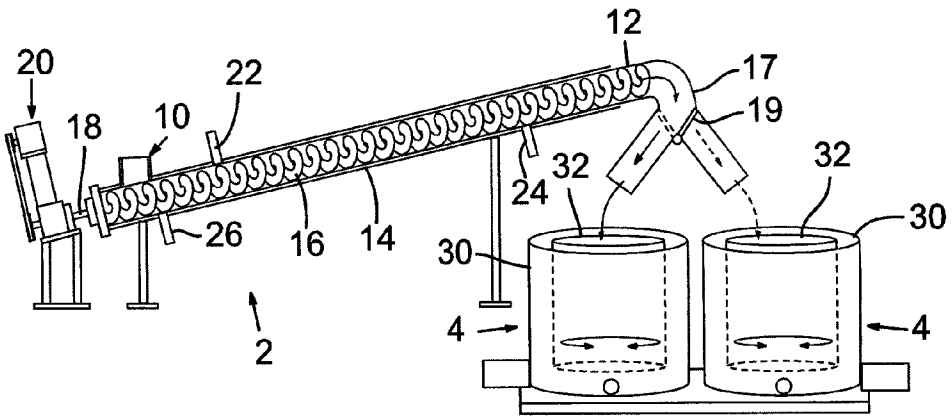
FIG. 2. shows an exemplary seed cleaning system including an auger portion and a centrifuge portion having more than one centrifuge.
Figure 8:
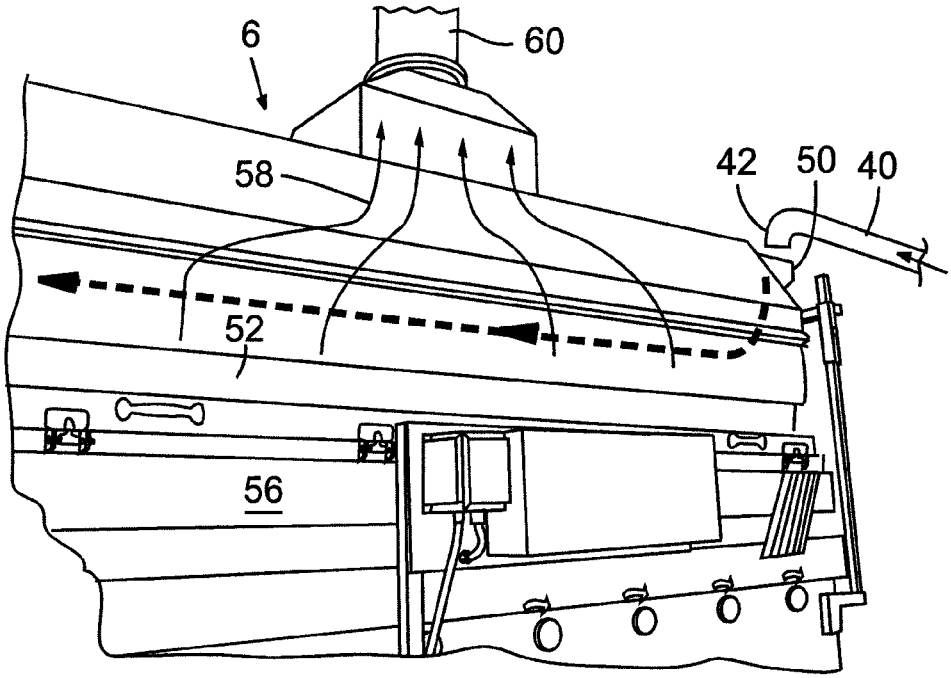
FIGS. 8 and 9 show an exemplary dryer portion of a seed cleaning system.
Figure 9:
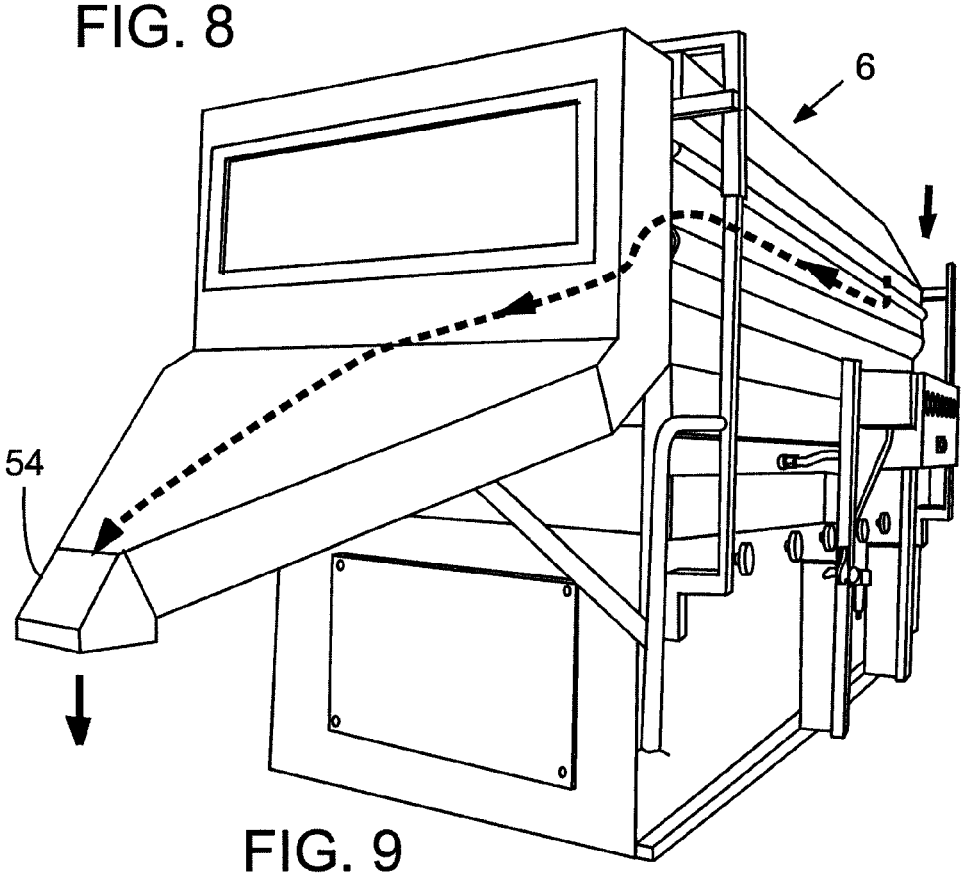

Seed to be dried, such as seed exiting the centrifuge 4, can be transported into the dryer portion 6, as shown in FIGS. 1, 8 and 9. An exemplary dryer portion 6 can comprise a fluidized bed dryer in which the seed is vibrated across a bed 52 while heated air 56 is passed upward through the bed where the air extracts additional moisture from the seed before the moisture-laden air 58 is ventilated out through an upper opening 60. After seed is deposited into the inlet 50 (see FIG. 8), the seed then moves gradually across the dryer bed 52 and exits the dryer 6 through outlet 54 where it is bagged or otherwise further processed.

The dryer portion 6 can reduce the moisture content of the seed to any desired level by adjusting the drying time, temperature, and/or other parameters. A desirable moisture content for seed that is to be packaged and shipped can be less than 13%, less than 11%, between 7% and 11%, and/or about 8-10%, for example. The temperature of the dryer 6 can be hotter near the input 50 end of the bed 52 and lower near the output 54 end of the bed 52 to protect the seed during the drying process and gradually bring the seed back to an ambient condition. In some embodiments of the seed cleaning system, the dryer 6 can be a bottleneck in the continuous system. For example, an exemplary fluidized bed dryer can limit a maximum processing rate of the system to about 500-1000 pounds of seed per hour.

Batch Processes

In an alternative process, the centrifuge 4 can be used as both a washer and a dryer, without the auger portion 2. Dirty seed can be loaded directly into the centrifuge 4 in a batch process. Cleaning liquid can be added into the inner basket 30 via the conduit 37, the lid 38 can be closed, and the centrifuge 4 can be operated similar to a conventional clothes washing machine. After the liquid inflow is stopped, the inner basket 32 can continue to be rotated to spin-dry the seed. The lid 38 can then be opened and the seed removed for further drying if necessary.

Control System

A control system can be included that controls one or more aspects of the seed washing and drying processes. The control system can include at least one computer or a computing environment, which can include one or more processors, memory, storage devices, input devices, output devices, and/or communication connections. The control system can further include one or more sensors positioned in the auger portion 2, the centrifuge portion 4, and/or in the drying portion 6 for sensing conditions, such as auger temperatures, moisture content, water level, fluid flow rates, auger and centrifuge rotation rates, etc., and providing feedback to the control system. The control system can further include software, including computer-readable instructions, for controlling and/or operating the system in a desired manner. For example, the software can be used to determine when to start or stop the washing and/or drying processes and can regulate temperatures, speeds and flow rates various portions of the system.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An apparatus for removing soil from seed, comprising:

an inclined inner enclosure comprising a first end portion and a second end portion having a higher elevation than the first end portion;

a seed input adjacent the first end portion for introducing seed having a first soil content into the inner enclosure, and a seed output adjacent the second end portion for outputting seed having a second soil content from the inner enclosure, the second soil content being less than the first soil content;

a liquid inlet for introducing liquid into the inner enclosure and at least one liquid outlet in the inner enclosure between the seed input and the seed output, the liquid outlet configured to drain liquid and soil from the inner enclosure; and a coreless auger positioned within the inner enclosure and extending from adjacent the seed input to adjacent the seed output, the auger configured to rotate relative to the inner enclosure and convey seed from the seed input toward the seed output.

2. The apparatus of claim 1, wherein the second soil content is less than 0.01%.

3. The apparatus of claim 1, wherein the at least one liquid output comprises a plurality apertures located in a bottom portion of the inner enclosure.

4. The apparatus of claim 1, further comprising a mesh screen covering the liquid outlet, the mesh screen comprising apertures sized smaller than the seed, the mesh screen allowing liquid and soil to pass through the liquid outlet.

5. The apparatus of claim 4, wherein the mesh screen is positioned between the auger and an inner surface of the inner enclosure.

6. The apparatus of claim 3, wherein the plurality of apertures comprise at least one aperture positioned below an operational liquid level within the enclosure and a slotted aperture positioned above the operational liquid level.

7. The apparatus of claim 1, further comprising a trough positioned below the inner enclosure and configured to contain liquid and soil drained from the inner enclosure.

8. The apparatus of claim 1, wherein liquid exiting the liquid outlet is recycled back into the liquid inlet.

9. The apparatus of claim 1, wherein the seed is creeping bentgrass seed.

10. The apparatus of claim 1, wherein the coreless auger rotates about a non-linear axis of rotation within the inner enclosure.

11. A system for removing soil from seed, comprising:

an auger portion comprising an inclined enclosure and an auger positioned within the enclosure, the auger portion configured to mix seed with a liquid within the enclosure, to remove soil from the seed using the auger, and to separate washed seed from the liquid and the removed soil;

a centrifuge portion comprising at least one centrifuge having an outer drum and a rotatable inner basket positioned within the outer drum, the inner basket comprising a side wall having a plurality of apertures, the inner basket configured to receive washed seed from the auger portion within the inner basket and to centrifugally separate additional liquid from the washed seed, the separated liquid passing through the plurality of apertures into the outer drum; and a dryer portion configured to receive partially dried seed from the centrifuge portion and configured to further reduce moisture content of the seed to below a threshold level using heat.

12. The system of claim 11, wherein the centrifuge portion comprises at least two centrifuges.

13. The system of claim 12, wherein the auger portion further comprises a forked seed outlet coupled to the inclined enclosure and comprising an adjustable valve for selectively conducting washed seed into different centrifuges.

14. The system of claim 12, wherein the system is configured to continuously output washed seed from the auger portion into at least one of the centrifuges while at least another of the centrifuges rotates to dry washed seed.

15. The system of claim 11, wherein the at least one centrifuge further comprises a mesh screen coupled to an inner surface of the side wall of the inner basket, the mesh screen covering the plurality of apertures in the side wall, the mesh screen comprising apertures sized smaller than the seed.

16. The system of claim 11, wherein the centrifuge further comprises a stir bar pivotally mounted to the outer drum such that, when the stir bar is in an operation position, the stir bar is positioned within the inner basket adjacent the side wall and causes seed to move inwardly away from the side wall when the inner basket is rotated.

17. The system of claim 11, further comprising a conveyor mechanism configured to transport seed from the centrifuge portion to the dryer portion, and wherein the inner basket is removable from the centrifuge portion such that seed contained in the inner basket can be transferred to the conveyor mechanism.

18. The system of claim 11, wherein the dryer portion comprises a seed inlet, a drying bed within an enclosure, a seed outlet, a heated air source, and a heated air outlet, wherein the dryer portion is configured to move seed via vibration from the seed inlet, across the drying bed and to the seed outlet while heated air draws moisture from the seed and out of the enclosure via the heated air outlet.

19. The system of claim 11, wherein the moisture content of the seed exiting the auger portion is greater than 25%, the moisture content of the seed exiting the centrifuge portion is less than 25%, and the moisture content of the seed exiting the dryer portion is less than 10%.

20. A method of removing soil from grass seed, comprising:

introducing grass seed and a liquid into a lower end portion of an inclined tubular enclosure, the enclosure containing a rotatable coreless auger extending from the lower end portion to an upper end portion of the enclosure;

rotating the auger to mix the grass seed with the liquid to separate soil from the grass seed while moving the grass seed from the lower end portion of the enclosure toward the upper end portion of the enclosure;

draining the liquid and removed soil from the enclosure via at least one drain aperture in the enclosure located between the lower and upper end portions of the enclosure;

outputting washed grass seed from the upper end portion of the enclosure into a centrifuge;

spinning the centrifuge to reduce the moisture content of the grass seed; and further reducing the moisture content of the grass seed using heat.

* * * * *